US007051632B2

(12) United States Patent
Hamilton et al.

(10) Patent No.: US 7,051,632 B2
(45) Date of Patent: May 30, 2006

(54) MAGNETIC ROTARY DIE

(75) Inventors: James T. Hamilton, Naperville, IL (US); Randy S. Riley, Plainfield, IL (US)

(73) Assignee: Paper Benders Supply, Inc., Plainfield, IL (US)

( * ) Notice: Subject to any disclaimer, the term of this patent is extended or adjusted under 35 U.S.C. 154(b) by 0 days.

(21) Appl. No.: 10/774,191

(22) Filed: Feb. 6, 2004

(65) Prior Publication Data

US 2005/0045005 A1 Mar. 3, 2005

Related U.S. Application Data

(63) Continuation-in-part of application No. 10/654,656, filed on Sep. 3, 2003.

(51) Int. Cl.
*B26D 1/56* (2006.01)

(52) U.S. Cl. ..... 83/343; 83/698.21

(58) Field of Classification Search ..... 83/13, 83/24, 346, 698.21, 698.42, 911, 152, 37, 83/343, 347, 98–100, 40, 698.51, 698.11, 83/663; 462/8, 13; 101/DIG. 36, 486
See application file for complete search history.

(56) References Cited

U.S. PATENT DOCUMENTS 3,668,752 A * 6/1972 Clifton et al. ..... 492/8
3,670,646 A * 6/1972 Welch, Jr. ..... 101/389.1
3,824,927 A * 7/1974 Pugh et al. ..... 101/378
3,826,170 A * 7/1974 Jones et al. ..... 83/657
3,850,059 A * 11/1974 Kang ..... 83/880
3,897,292 A * 7/1975 Fukuyama ..... 156/153
3,965,786 A * 6/1976 D'Luhy ..... 83/346
3,969,474 A * 7/1976 Gaug ..... 264/219
4,744,297 A * 5/1988 Sardella et al. ..... 101/382.1
4,831,930 A * 5/1989 Leanna ..... 101/389.1
4,985,972 A * 1/1991 Sollinger et al. ..... 492/7
5,001,950 A * 3/1991 Fokos et al. ..... 83/37
5,030,937 A * 7/1991 Loubier et al. ..... 335/303
5,230,271 A * 7/1993 Hardisty et al. ..... 83/698.21
5,379,671 A * 1/1995 Kang ..... 83/698.11
5,505,109 A * 4/1996 Okonski et al. ..... 83/622
5,555,786 A * 9/1996 Fuller ..... 83/663
5,711,223 A * 1/1998 Taylor ..... 101/389.1
5,938,579 A * 8/1999 Cavazos ..... 492/8
6,026,725 A * 2/2000 Okonski ..... 83/698.21
6,067,887 A * 5/2000 Kapolnek ..... 83/698.41
6,105,651 A * 8/2000 Leanna ..... 156/555
RE38,033 E * 3/2003 Okonski et al. ..... 83/24

(Continued)

*Primary Examiner*—Allan N. Shoap
*Assistant Examiner*—Ghassem Alie
(74) *Attorney, Agent, or Firm*—Trexler, Bushnell, Giangiorgi, Blackstone & Marr, Ltd.

(57) ABSTRACT

A rotary cutting die which is mountable on a metal cylinder. The rotary cutting die includes a rotary die plate having a concave, inner surface which is magnetically attractable and magnetically mountable on a metal cylinder. A cutting blade is mounted on a concave, outer surface of the die plate. Connectors may be engaged with the cutting blade and the die plate. A plurality of magnetic elements, such as neodymium magnets, are in the rotary die plate. The magnetic elements make the inner surface of they die plate magnetically attractable to the metal cylinder, thereby providing that the rotary cutting die is mountable on the metal cylinder without having to use screws, clamps or other mechanical holding devices. To prevent creep of the cutting die during operation, a magnetic member, such as a rubber magnet, may be magnetically mounted on the die cylinder, against the die plate.

9 Claims, 2 Drawing Sheets

U.S. PATENT DOCUMENTS 6,532,854 B1 * 3/2003 Okonski et al. ..... 83/698.41
2002/0054470 A1 * 5/2002 Kuriyama ..... 361/302
2003/0031838 A1 * 2/2003 Bourdelais et al. ..... 428/195
2003/0209112 A1 * 11/2003 Huang ..... 81/125

* cited by examiner

MAGNETIC ROTARY DIE

RELATED APPLICATION (PRIORITY CLAIM)

This application is a continuation-in-part of U.S. patent application Ser. No. 10/654,656, filed Sep. 3, 2003, which is hereby incorporated herein by reference in its entirety.

BACKGROUND OF THE INVENTION

The present invention relates generally to the field of rotary cutting dies, and relates more specifically to an improved design for the use of such dies.

Rotary cutting dies have been manufactured and used for numerous years. Rotary cutting dies are disclosed, for example, in the following U.S. Pat. Nos. 2,993,421; 3,969,474; 4,210,047; 5,379,671; 5,595,093; and 6,067,887, all of which are incorporated herein by reference in their entirety. Conventionally, rotary cutting dies are formed from a resinous die plate material which supports a steel cutting blade. The cutting blade extends above the surface of the resin die plate and defines the cutting shape. The shape created by the steel cutting blade is employed to cut, score or perforate material such as paper, cardboard or the like, through the rotary cutting process. Usually, rotary cutting dies are sized to be mounted either on discrete sections of a rotary cutting machine die cylinder or along the entire surface thereof. To accommodate either type of die, the die cylinder typically contains a number of receiving holes spaced at predetermined intervals. The receiving holes are positioned in an array along the die cylinder, and are configured to receive screws and clamps that mount on the die cylinder and extend over the edge of the die plate to affix the die to the die cylinder. The die clamps must have an elongated screw hole to allow the die to be mounted either closer or further away form the screw hole. This system is cumbersome and time consuming which means that valuable time and money are wasted just trying to get the die plates precisely located and attached. Most often, die plates require position adjustments which means more lost time and wasted paper. Each die position adjustment requires loosening of screws and clamps or even moving a screw to a different screw hole.

SUMMARY OF THE INVENTION

An object of an embodiment of the present invention is to provide a rotary cutting die which is magnetic. By using a magnetic rotary cutting die, screws and clamps need not be used, and the die can be repositioned on the die cylinder by taping lightly on the die plate, moving it in the direction of the desired position adjustment. Occasionally, excessive cutting pressure may cause the magnetic die plate to creep out of position. Therefore, preferably a magnet is positioned on the die cylinder, against the die plate, to prevent creeping. The difference in die positioning cost between the screw change method and the magnetic die method is substantial.

Another embodiment of the present invention provides a unique method for quickly and easily mounting epoxy-based dies to a die cylinder, thereby greatly reducing the time it takes to mount the die to the die cylinder and subsequently reposition the die, if necessary. The method provides that a magnetic rotary die is contacted with a die cylinder such that the rotary die becomes magnetically attached to the cylinder. Subsequently, if the die is to be repositioned, it is tapped into the desired position, or is removed from the die and reattached, magnetically. The method effectively eliminates the laborious task of having to loosen, tighten and move screws and clamps.

According to another embodiment of the invention, a number of magnetic elements are encapsulated in the resinous material used to form the die plate. The presence of the magnetic elements allows the die plate to be mounted to a steel die cylinder without having to use cumbersome die screws and die clamps. In a specific embodiment, a rotary cutting die is provided that includes magnetic elements encapsulated in the resinous die plate having an inner surface and an outer surface. A cutting blade, defining a predetermined shape, is provided on the outer surface of the die plate. A plurality of connectors are engaged with the die plate and with openings in the cutting blade, thereby serving to secure and support the cutting blade relative to the rotary die plate.

Still another embodiment of the present invention provides a rotary cutting machine which includes a steel die cylinder, a rotary cutting die mounted on the steel die cylinder, and an opposing cylinder positioned parallel to and in the opposite rotary relationship with the die cylinder. The rotary die includes a magnetic rotary die plate having an inner surface and an outer surface. A cutting blade defining a shape and having a cutting edge and a support edge, is supported in the rotary magnetic die plate. The opposing cylinder and the cutting blade supported in the rotary magnetic die plate cooperate to cut, score or perforate a material in the pattern of the shape.

Yet still another embodiment of the present invention provides a method for rotary magnetic die perforating, cutting, or scoring using a magnetic rotary die plate. The method includes providing a magnetic rotary cutting die, having a curved, magnetic rotary die plate and a cutting blade supported in the rotary die plate. The rotary die plate is mounted on a die cylinder of a rotary cutting machine by means of magnetic attraction between the encapsulated magnets in the die plate and the steel die cylinder.

BRIEF DESCRIPTION OF THE DRAWINGS

The organization and manner of the structure and operation of the invention, together with further objects and advantages thereof, may best be understood by reference to the following description, taken in connection with the accompanying drawing, wherein:

FIG. 3 is a cross-sectional view of the magnetic rotary cutting die mounted on a steel die cylinder and an opposing anvil cylinder that is contacting the magnetic die cutting edge to create a cutting action, wherein FIG. 3 shows the magnetic cutting die plate followed by a section of magnetic rubber.

DETAILED DESCRIPTION OF THE PRESENTLY PREFERRED EMBODIMENTS

Figure 1:
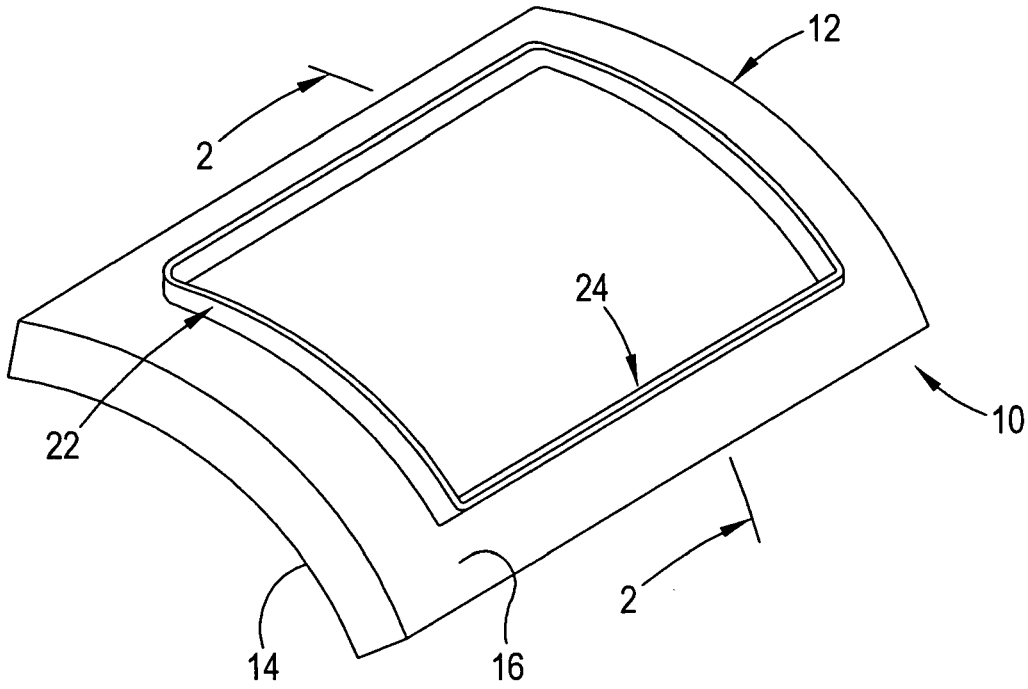
FIG. 1 is a perspective view of a rotary cutting die which is in accordance with an embodiment of the present invention, wherein the cutting die is magnetic.

While the invention may be susceptible to embodiment in different forms, there are shown in the drawings, and herein will be described in detail, specific embodiments of the invention. The present disclosure is to be considered an example of the principles of the invention, and is not intended to limit the invention to that which is illustrated and described herein.

Figure 2:
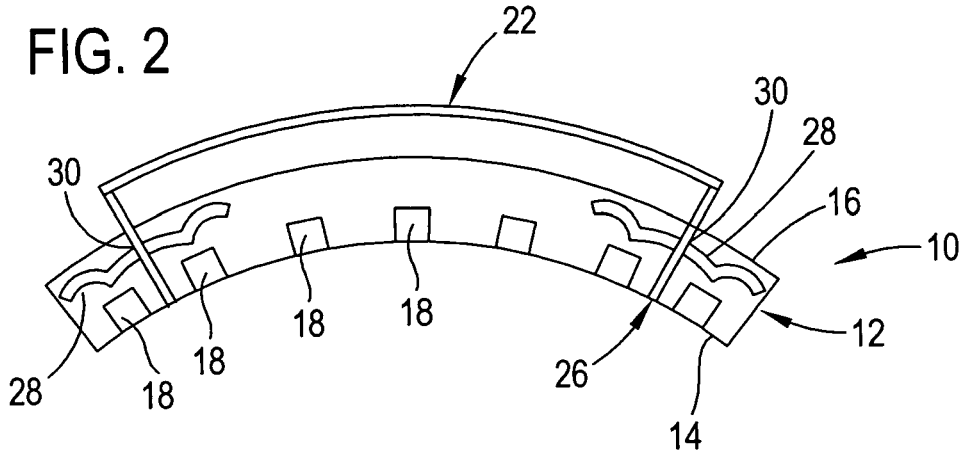
FIG. 2 is a cross-sectional view of the rotary cutting die shown in FIG. 1, taken along line 2—2 of FIG. 1.

FIGS. 1 and 2 illustrate a rotary cutting die 10 which is in accordance with an embodiment of the present invention.

The rotary cutting die 10 is magnetic in that it is mountable to a metal cylinder via magnetic attraction. By using a magnetic rotary cutting die, screws and clamps need not be used, and the die can be repositioned on the die cylinder by taping it lightly.

Figure 3:
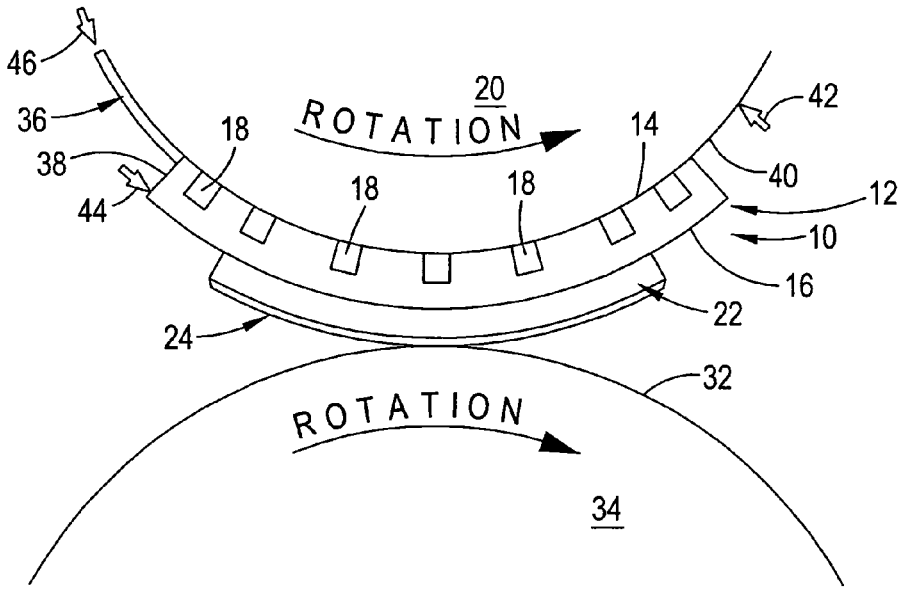

The cutting die 10 includes a rotary die plate 12 which is curved, or arcuate, and includes a concave, inner surface 14 and a convex, outer surface 16. A plurality of magnetic elements 18 are impregnated in the rotary die plate 12, proximate the inner surface 14. As shown in FIG. 3, the magnetic elements 18 make the inner surface 14 magnetically attractable to and magnetically mountable on a metal, such as steel, die cylinder 20. The magnetic elements may be, for example, neodymium magnets, 0.375" wide×0.100" thick, nickel coated and magnetized through 0.100", available from Arnold Magnetics, LTD., 770 Linden Ave., Rochester, N.Y. 14625.

Preferably, the die plate 12 is formed of an epoxy or resinous material which is initially a liquid, but which thereafter solidifies to form the die plate 12. Preferably, the resinous material possesses a low shrink factor, thus forming a die plate with minimum distortion. The resin may be, for example, 301 aluminum filled, available from Epoxical Inc., 275 Bridge Point Drive, So. St. Paul, Minn. 55075.

The cutting die 10 includes a cutting blade 22 which is disposed on the outer surface 16 of the die plate 12. The cutting blade 22 has a cutting edge 24 which extends above the outer surface 16 of the rotary die plate 12. The cutting edge 24 forms a predetermined cutting shape (i.e., such as a rectangle with rounded corners, as shown in FIG. 1). The cutting edge 24 is preferably sharp to enable it to cut, score or perforate a shape into a given material, such as paper. Preferably, the cutting edge 24 extends 0.125 to 0.1875 inches above the outer surface 16 of the rotary die plate 12. However, as those skilled in the art will appreciate, the cutting edge 24 can extend to any distance dictated by a specific application without departing from the spirit and scope of the present invention.

As shown in FIG. 2, a support edge 26 is disposed within the rotary die plate 12. Preferably, the cutting blade 22 has a number of connectors 28 placed through openings 30 in the cutting blade 22, and the connectors 28 serve to secure the cutting blade 22 relative to the die plate 12. The connectors 28 may be as shown in U.S. Pat. No. 6,067,887, which is hereby incorporated herein by reference.

FIG. 3 is a cross sectional view of the magnetic rotary die 10 mounted on a die cylinder 20 and being held thereon by the magnetic force created between magnets 18 encapsulated in the rotary die plate 12 and the magnetically-attractable steel die cylinder 20. While some distortion of the die plate 12 is inevitable, preferably the magnetic force between the die plate 12 and the cylinder 20 is sufficient to pull the die plate 12 down to the die cylinder, thus eliminating any distortion created by the solidifying of the resinous material in forming the solid magnetic die plate 12.

As shown in FIG. 3, during a cutting, perforating, etc. process, the cutting edge 24 contacts surface 32 of an opposing cylinder 34, thereby creating a cutting action. Preferably, a magnetic member, such as a magnetic rubber section 36, is placed against a trailing edge 38 of the rotary die plate 12 to eliminate the tendency of the magnetic rotary die plate 12 to creep backwards on the die cylinder 20, while the die cylinder 20 and opposing cylinder 34 are rotating and the cutting edge 24 is cutting. Preferably, the magnetic rubber 36 has a substantially higher coefficient of friction (μ) with the steel die cylinder 20 than does the inner surface 14 of the magnetic rotary die plate 12. This makes the magnetic rubber 36 a better resistor to creeping than the magnetic die plate 12. The magnetic member 36 may be, for example, MA 1810, 3 inches wide by 0.060 inches thick by 3 inches long, having a holding power of 1.5 pounds per square inch, capable of being cut into various sizes, and available from Bunting Magnetics Co., 500 S. Spencer Ave., Newton, Kans. 67114-0468, wherein the coefficient of friction (μ) between the resin-based die plate 12 and an eight micro finish die cylinder cylindrical surface (i.e., the surface 40 of die cylinder 20) is 0.176. In comparison, the coefficient of friction (μ) between the magnetic rubber 36 and the eight micro finish die cylinder cylindrical surface (i.e., the surface 40 of die cylinder 20) may be 0.364, or more than two times the coefficient of friction (μ) between the die plate 12 and the die cylinder surface 40.

The fact that the die plate 12 is magnetically attracted to the die cylinder 20 provides that the cutting die 10 is mountable to the die cylinder 20 merely by bringing (as represented by arrow 42 in FIG. 3) the inner surface 14 of the die plate 12 in close enough proximity to the die cylinder 20. Once the cutting die 10 is magnetically mounted on the die cylinder 20, the cutting die 10 can be repositioned on the cylinder 20 merely by tapping (as represented by arrow 44 in FIG. 3) on the die plate 12 in the direction of the desired, final location of the cutting die 10 on the die cylinder 20. Of course, if the magnetic rubber section 36 is being used, that too will need to be repositioned (as represented by arrow 46 in FIG. 3).

To make the cutting die 10, the following method can be used: magnets 18 are stacked two high creating a 0.375 by 0.200 inch sandwich. Each stack has a holding power of 4 pounds per square inch. Then, using the die weight, the die cylinder pitch diameter, and the expected web speed of the die cutter, it can be determined how many pounds of force will be required to hold the die to the die cylinder at maximum web speed. Using a safety factor of 2×, it can be calculated how many magnet sandwiches need to be cast into the die base. The die maker then places the required magnets at various spots around the die shape, mounted against the non-magnetic phenolic master blocks which are 0.125 inches thick. The master blocks are mounted on a steel semi-cylindrical sleeve which attracts the magnets to the master blocks, thus holding the magnets in the desired position. Next, the die maker closes the die mold with a steel cylinder, which will close to within 0.050 inches of the magnets. At this point, the magnets move to the steel cylinder because the gap between the magnet and the concave steel female mold is 0.125 inches and the gap between the male mold and the magnets is 0.050 inches. This then positions the magnets in a position that will be in the base of the resin die, thus creating the highest possible magnetic attraction once the completed die is placed on a steel die cylinder.

Another way to make the resin-based cylindrical die magnetic is by substituting fine grain (0.0025 inch) neodymium in place of the aluminum and fine grain filler in the epoxical 301 epoxy system. Then, use this mixture to cast a steel blade cylindrical die. Then, this cast die is placed on an electrical magnet which is composed of eight poles or more per inch to convert the epoxical base into a permanent magnet. The fine grain neodymium and the multi pole electromagnet can be obtained through Arnold Engineering.

While embodiments of the present invention are shown and described, it is envisioned that those skilled in the art may devise various modifications of the present invention without departing from the spirit and scope of the appended claims.

What is claimed is:

1. A rotary cutting die mountable on a metal cylinder, said rotary cutting die comprising: a rotary die plate having an inner surface and an outer surface, said inner surface of said rotary die plate being magnetically attractable and magnetically mountable on the metal cylinder; and a cutting blade mounted on the outer surface of the rotary die plate, wherein said rotary die plate is formed of a solidified resin having a plurality of magnetic elements disposed within the resin, said magnetic elements configured to make said inner surface magnetically attractable to the metal cylinder, wherein said rotary die plate is configured such that said inner surface of said rotary cutting die is magnetically attracted to the metal cylinder such that the inner surface of the rotary cutting die is contactably mountable on the metal cylinder without having to use mechanical holding devices including screws and clamps.

2. A rotary cutting die as recited in claim 1, wherein said magnetic elements comprise neodymium magnets configured to make said inner surface of said rotary die plate magnetically attractable to the metal cylinder.

3. A rotary cutting die as recited in claim 1, said cutting blade having a cutting edge which extends at least 0.125 inches above an outter surface of the rotary die plate.

4. A rotary cutting die as recited in claim 2, wherein said neodymium magnets are disposed proximate said inner surface.

5. A rotary cutting system comprising: a rotary cutting die having an inner surface and an outer surface; a metal cylinder, said inner surface of said rotary die plate being magnetically attracted to and magnetically mounted on the metal cylinder; and a cutting blade mounted on the outer surface of the rotary die plate, wherein said rotary die plate is formed of a solidified resin having a plurality of magnetic elements disposed within the resin, said magnetic elements configured to make said inner surface magnetically attracted to the metal cylinder, wherein said rotary die plate is configured such that said inner surface of said rotary cutting die is magnetically attracted to the metal cylinder such that the inner surface of the rotary cutting die is contactably mountable on the metal cylinder without having to use mechanical holding devices including screws and clamps.

6. A rotary cutting system as recited in claim 5, wherein said magnetic elements comprise neodymium magnets configured to make said inner surface of said rotary die plate magnetically attractable to the metal cylinder.

7. A rotary cutting system as recited in claim 5, said cutting blade having a cutting edge which extends at least 0.125 inches above an outer surface of the rotary die plate.

8. A rotary cutting system as recited in claim 6, wherein said neodymium magnets are disposed proximate said inner surface.

9. A rotary cutting system as recited in claim 5, further comprising a magnetic member on said metal cylinder, in contact with said rotary cutting die, said magnetic member configured to reduce creeping of said rotary cutting die along said metal cylinder while said cutting blade is cutting during rotation of said metal cylinder.

* * * * *